United States Patent [19]

Hotate et al.

[11] Patent Number: 4,691,677

[45] Date of Patent: Sep. 8, 1987

[54] THROTTLE VALVE CONTROL SYSTEM FOR INTERNAL COMBUSTION ENGINE

[75] Inventors: Makoto Hotate; Toshio Nishikawa; Kobuo Takeuchi; Itaru Okuno; Tadataka Nakazumi, all of Hiroshima, Japan

[73] Assignee: Mazda Motor Corp., Japan

[21] Appl. No.: 820,613

[22] Filed: Jan. 21, 1986

[30] Foreign Application Priority Data

Jan. 24, 1985 [JP] Japan ..... 60-12007

[51] Int. Cl.[4] ..... F02D 41/10; F02D 41/12

[52] U.S. Cl. ..... 123/399; 123/361

[58] Field of Search ..... 123/399, 396, 361, 403

[56] References Cited

U.S. PATENT DOCUMENTS

| | | | |
|---|---|---|---|
| 4,112,885 | 9/1978 | Iwata et al. | 123/361 |
| 4,168,679 | 9/1979 | Ikeura et al. | 123/399 |
| 4,471,610 | 9/1984 | Watamabe | 123/399 |
| 4,508,078 | 4/1985 | Takeuchi et al. | 123/399 |
| 4,519,361 | 5/1985 | Murakami | 123/403 |
| 4,546,736 | 10/1985 | Moriya et al. | 123/491 |
| 4,601,271 | 7/1986 | Ejiri et al. | 123/399 |

FOREIGN PATENT DOCUMENTS

| | | |
|---|---|---|
| 59-10749 | 1/1984 | Japan . |
| 59-10750 | 1/1984 | Japan . |
| 59-10752 | 1/1984 | Japan . |
| 59-10753 | 1/1984 | Japan . |

*Primary Examiner*—William A. Cuchlinski, Jr.
*Attorney, Agent, or Firm*—Gerald J. Ferguson, Jr.; Michael P. Hoffman; Ronni S. Malamud

[57] ABSTRACT

A throttle valve control system comprises an accelerator position sensor for detecting the amount of operation of the accelerator, a throttle valve opening degree determining circuit which receives the output of the accelerator position sensor and determines the opening degree of the throttle valve, and a throttle valve driving device which drives the throttle valve to the position corresponding to the opening degree determined by the throttle valve opening degree determining circuit. The throttle valve opening degree determining circuit is arranged to determine the opening degree of the throttle valve with respect to the amount of operation of the accelerator so that the change in the opening degree of the throttle valve for a given change in the amount of operation of the accelerator is relatively small when the amount of operation of the accelerator is in an intermediate range and is relatively large when the amount of operation of the accelerator is above or below the intermediate range.

10 Claims, 5 Drawing Figures

THROTTLE VALVE CONTROL SYSTEM FOR INTERNAL COMBUSTION ENGINE

BACKGROUND OF THE INVENTION

1. Field of the Invention

This invention relates to a throttle valve control system for an internal combustion engine, and more particularly to a system for electrically controlling the throttle valve in response to operation of the accelerator.

2. Description of the Prior Art

In U.S. Pat. No. 4,112,885, there is disclosed an electric control type throttle valve control system in which movement of the accelerator is converted to an electric signal and a driving motor for driving the throttle valve is energized according to the electric signal to open and close the throttle valve in response to the movement of the accelerator. This system is advantageous over conventional throttle valve control systems, in which the throttle valve and the accelerator are mechanically connected with each other by a link mechanism, a wire mechanism or the like, in that the throttle valve can be relatively freely controlled to obtain a desired engine output, and that the accelerator depression effort can be minimized.

However, the conventional electric control type throttle valve control system is disadvantageous in that the amount of intake air does not linearly change with respect to the amount of depression of the accelerator pedal since the throttle valve and the accelerator are operatively connected so that the opening degree of the throttle valve linearly changes with respect to the amount of operation of the accelerator as in the conventional mechanical throttle valve control system and the change in the effective opening area of the intake passage for a given change in the opening degree of the throttle valve differs with the opening degree of the throttle valve. Therefore, during cruising in which the amount of operation of the accelerator is intermediate, a slight change in the amount of operation of the accelerator reduces or increases intake air by a large amount so as to adversely affect stability during cruising. On the other hand, when the accelerator is further pressed down during travel at a wide throttle to accelerate the vehicle, the amount of intake air is hardly increased and accordingly, the vehicle cannot be satisfactorily accelerated. Further, since the amount of intake air hardly changes with change in the amount of operation of the accelerator when the opening degree of the throttle valve is low, response of the engine is slow upon starting.

SUMMARY OF THE INVENTION

In view of the foregoing observations and description, the primary object of the present invention is to provide an electric control type throttle valve control system in which the amount of intake air is linearly related to the amount of operation of the accelerator, whereby stability during cruising can be ensured, acceleration during heavy load operation can be improved and response of the engine upon starting can be improved.

The throttle valve control system in accordance with the present invention comprises an accelerator position sensor for detecting the amount of operation of the accelerator, a throttle valve opening degree determining means which receives the output of the accelerator position sensor and determines the opening degree of the throttle valve, and a throttle valve driving means which drives the throttle valve to the position corresponding to the opening degree determined by the throttle valve opening degree determining means, the throttle valve opening degree determining means being arranged to determine the opening degree of the throttle valve with respect to the amount of operation of the accelerator so that the change in the opening degree of the throttle valve for a given change in the amount of operation of the accelerator is relatively small when the amount of operation of the accelerator is in an intermediate range and is relatively large when the amount of operation of the accelerator is above or below the intermediate range.

With this arrangement, the accelerator operationintake air amount characteristics (the relation between the amount of operation of the accelerator and the amount of intake air introduced into the combustion chamber) can be made substantially linear. BRIEF DESCRIPTION OF THE DRAWINGS FIG. 1 is a schematic view showing an internal combustion engine provided with a throttle valve control system in accordance with an embodiment of the present invention, FIG. 2 is a view for illustrating the operation of the computer unit employed in the throttle valve control system, FIG. 3 is a graph showing accelerator operationthrottle valve opening degree characteristic curves employed in the throttle valve control system, FIG. 4 is a view showing a flow chart for illustrating the operation of the computer unit, and FIG. 5 is a view showing the accelerator operationintake air amount characteristics obtained by the throttle control system in comparison with those of the conventional throttle control system.

DESCRIPTION OF THE PREFERRED EMBODIMENT

Figure 1:
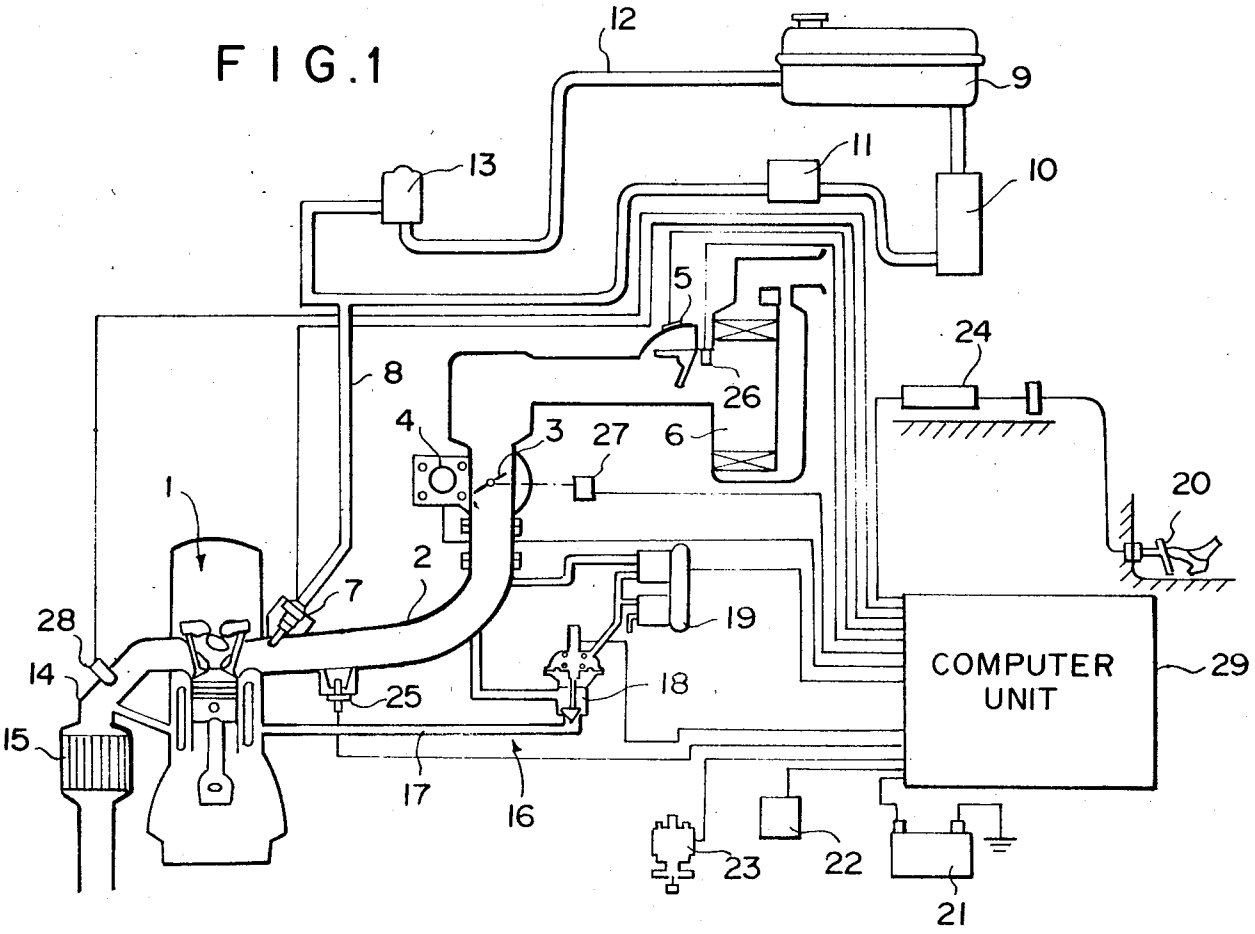

In FIG. 1, an internal combustion engine 1 is provided with an intake passage 2. At an intermediate portion of the intake passage 2 is disposed a throttle valve 3 which is opened and closed by a throttle actuator 4 which may be a stepping motor, a DC motor or the like. A vane type airflow meter 5 is disposed in the intake passage 2 upstream of the throttle valve 3, and an air cleaner 6 is mounted on the upstream end of the intake passage 2.

A fuel injection valve 7 is disposed near the downstream end of the intake passage 2. The fuel injection valve 7 is connected to a fuel reservoir 9 by way of a fuel feed line 8. A fuel pump 10 and a fuel filter 11 are provided in the fuel feed line 8. A fuel return passage 12 connects the fuel reservoir 9 and a portion of the fuel feed line 8 downstream of the fuel filter 11, and a fuel pressure regulator 13 is provided in the fuel return passage 12, whereby fuel is fed to the fuel injection valve 7 under a fixed pressure.

An exhaust passage 14 of the engine 1 is provided with a catalytic convertor 15 for cleaning exhaust gas, and an exhaust gas recirculation system 16 is provided between the intake passage 2 and the exhaust passage 14. That is, one end of an exhaust gas recirculation passage 17 is connected to the exhaust passage 14 and the other end of the same is connected to the intake passage 2. The exhaust gas recirculation passage 17 is provided with an exhaust gas recirculation valve 18 which is driven by a solenoid 19.

The engine 1 is further provided with an accelerator pedal 20, battery 21, igniter 22, rpm sensor 23 for detecting the engine speed by way of the rotational angle of a distributor, accelerator position sensor 24 for detecting the amount of operation of the accelerator pedal 20, water temperature sensor 25 for detecting the temperature of engine coolant, intake air temperature sensor 26 for detecting the temperature of intake air, throttle position sensor 27 for detecting the opening degree of the throttle valve 3, oxygen sensor 28 for detecting the oxygen concentration in exhaust gas and computer unit 29 for controlling the throttle opening degree, fuel injection amount, exhaust gas recirculation amount and ignition timing.

Figure 2:
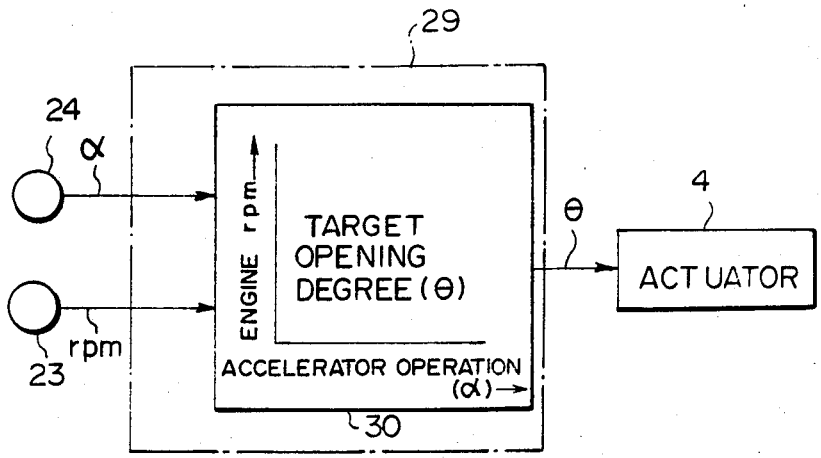
Figure 3:
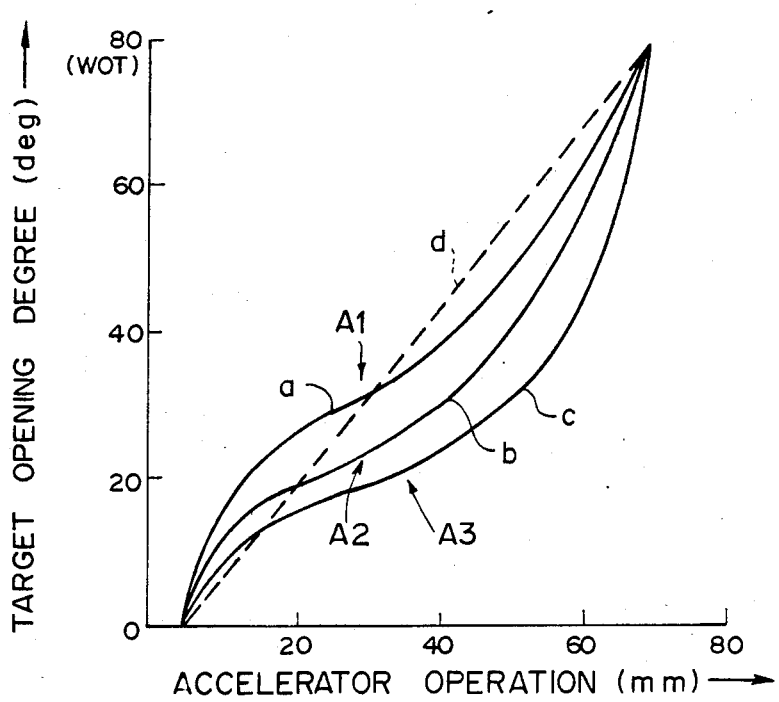

As shown in FIG. 2, the computer unit 29 includes a function generator 30 which generates a target throttle opening degree $\theta$ for a given amount of operation $\alpha$ of the accelerator pedal and a given engine rpm which are respectively input from the accelerator position sensor 24 and the rpm sensor 23. That is, the detected amount of operation $\alpha$ of the accelerator pedal 20 and the detected engine rpm are address-input into a predetermined two-dimensional memory map as a x value and a y value, and a stored value corresponding to the x and y values, i.e., the target throttle opening degree $\theta$ is read out. The function generator 30 has a plurality of such maps (in which the amount of operation $\alpha$ of the accelerator pedal 20 and the throttle opening degree $\theta$ are related to each other) and selects one of them for a given engine rpm. In this particular embodiment, the function generator 30 has three such maps as shown by characteristic curves a to c in FIG. 3. Each characteristic curve is arranged so that the change in the throttle opening degree for a given change in the amount of operation of the accelerator pedal is relatively small when the amount of operation of the accelerator is in a predetermined range (indicated at A1, A2 and A3 in the respective characteristic curves a, b and c) and is relatively large when the amount of operation of the accelerator pedal is above or below the predetermined range. The computer unit 29 selects one of the characteristic curves a to c so that the throttle opening degree for a given amount of operation of the accelerator pedal is increased as the engine rpm increases. That is, among the three characteristic curves a to c, the characteristic curve a is for the highest engine speed and the characteristic curve c is for the lowest engine speed. Generally, the maximum amount of intake air is determined by the engine rpm and accordingly, even if the throttle valve is opened beyond the opening degree corresponding to the maximum amount of intake air, the amount of intake air does not change. Accordingly, it is preferred from the viewpoint of efficiency of control that the throttle valve be not opened beyond the opening degree corresponding to the maximum amount of intake air determined by the engine rpm. This is the reason why a plurality of characteristic curves are prepared. In FIG. 3, dotted line d shows the same characteristic curve in the conventional mechanical throttle valve control system or the electric control type throttle valve control system in accordance with the prior art.

Figure 4:
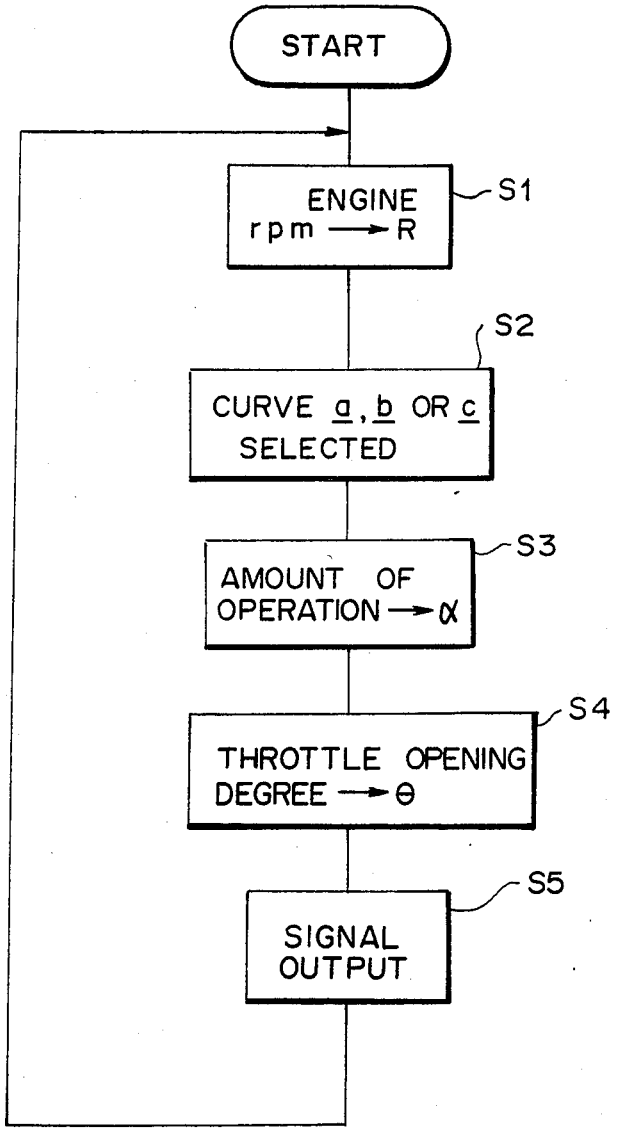

Operation of the computer unit 29 will now be described with reference to the flow chart shown in FIG. 4.

In step S1, the engine rpm R detected by the engine rpm sensor 23 is read in, and in step S2, one of the characteristic curves a to c is selected according to the engine rpm R. For example, when the engine rpm R is not lower than 4000 rpm, the curve a is selected, when the engine rpm R is lower than 4000 rpm and not lower than 2000 rpm, the curve b is selected, and when the engine rpm R is lower than 200 rpm, the curve a is selected. In step S3, the amount of operation $\alpha$ of the accelerator pedal 20 detected by the accelerator position sensor 24 is read in, and in step S4, the target opening degree $\theta$ of the throttle valve 3 corresponding to the detected amount of operation $\alpha$ of the accelerator pedal 20 is read from the characteristic curve selected in the step S2. Then in step S5, an electric signal corresponding to the read-out target opening degree $\theta$ is delivered to the throttle actuator 4. For example, the electric signal may represent the number of steps in the case that the throttle actuator is a stepping motor.

Figure 5:
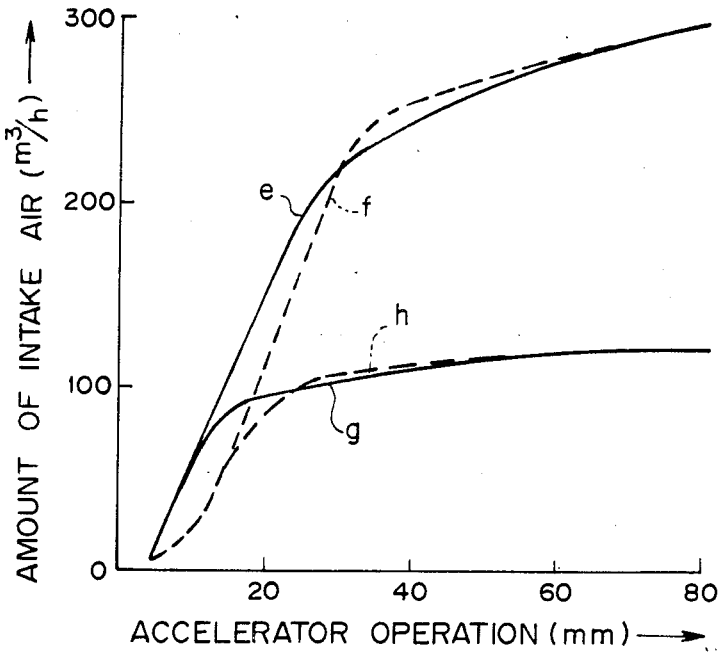

In FIG. 5, lines e and g show accelerator operation-intake air amount characteristics of the throttle valve control system in accordance with this embodiment at 4000 rpm and 2000 rpm, respectively, while lines f and h show the same characteristics of the throttle valve control system in accordance with the prior art at 4000 rpm and 2000 rpm, respectively. These lines are obtained by measuring the amount of intake air while the amount of operation $\alpha$ of the accelerator pedal 20 is changed with the engine rpm fixed at 4000 rpm and 2000 rpm.

As can be understood from FIG. 5, though all the characteristic curves e to h have a point at which the inclination sharply changes, the characteristic curves e and g for the control system of the present invention are superior to those f and h in linearity. Further, in the case of characteristic curves e and g, the inclination is larger in the range of the amount of operation of the accelerator pedal smaller than the point at which the inclination sharply changes.

Therefore, in accordance with the present invention, a sufficient amount of intake air can be obtained with a quick response to operation of the accelerator pedal in the range in which the amount of operation of the accelerator pedal is relatively small and accordingly the vehicle can be smoothly started.

Further, in the range of the amount of operation of the accelerator pedal which is frequently used during cruising of the vehicle, the change in the amount of intake air for a given change in the amount of operation is relatively small and accordingly, stability in the cruising can be improved.

When the vehicle is to be accelerated, torque shock can be reduced since the linearity in the accelerator operation-intake air amount characteristics is high in the throttle valve control system of the present invention. Especially, when the vehicle is to be accelerated from travel at a wide throttle, the vehicle can be accelerated with a quicker response than the conventional system since the inclination of the characteristic curve in the large range of the amount of operation of the accelerator pedal is larger in the system of the present invention than the conventional system.

Generally, in accordance with the throttle valve control system of the present invention, response of the vehicle speed or the engine output to change in the amount of operation of the accelerator can be improved.

Though it is changed according to the engine rpm in the embodiment described above, the accelerator operation-throttle valve opening degree characteristics may be changed according to other factors such as the amount of operation of the accelerator pedal upon initiation of depression of the same, the depressing speed of the accelerator pedal or the like.

Further, though said computer unit 29 accomplishes control on the amount of fuel to be injected, ignition timing and amount of exhaust gas to be circulated, such controls do not form a part of this invention and accordingly will not be described in detail here.

What is claimed is:

1. A throttle valve control system for an internal combustion engine comprising an accelerator position sensor for detecting the position of the accelerator, a throttle valve opening determining means which receives the output of the accelerator position sensor and determines the opening of the throttle valve, and a throttle valve driving means which drives the throttle valve to the position corresponding to the opening determined by the throttle valve opening determining means, wherein the improvement comprises that the throttle valve opening determining means includes means for determining the opening of the throttle valve in response to the position of the accelerator detected by the accelerator positon sensor such that the change in the opening of the throttle valve for a given change in the position of the accelerator is relatively small when the position of the accelerator is within a predetermined range and is relatively large when the position of the accelerator is both above and below the predetermined range.

2. A throttle valve control system as defined in claim 1 in which said throttle valve opening determining means comprises a memory in which values of the target throttle opening corresponding to positions of the accelerator are stored.

3. A throttle valve control system as defined in claim 2 in which a plurality of target throttle openings for a given position of the accelerator are stored in said memory and said throttle valve opening determining means selects one of the target throttle opening according to the engine rpm.

4. A throttle valve control system as defined in claim 1 in which said throttle valve opening determining means increases the throttle opening for a given position of the accelerator as the engine rpm increases.

5. A throttle valve control system as defined in claim 1 in which said throttle valve driving means comprises a stepping motor.

6. A thorttle valve control system as defined in claim 1 in which said throttle valve opening determining means determines the throttle opening as the full closure when the position of the accelerator corresponds to the minimum operation and as the full opening when the position of the accelerator corresponds to the maximum operation.

7. A throttle valve control system comprising:

an accelerator position sensor for detecting the position of the accelerator, first means which receives the output of the accelerator position sensor and determines the opening degree of the throttle valve in response to the position of the accelerator being between a minimum value and a first value such that the amount of change in the opening degree of the throttle value for a given change in the position of the accelerator is relatively large between full closure and a first degree of opening of the throttle valve respectively corresponding to the minimum value and the first value of the position of the accelerator, second means which receives the output of the accelerator position sensor and determines the opening degree of the throttle value in response to the position of the accelerator being between the first value and a second value such that the amount of change in the opening degree of the throttle value for a give change in the position of the accelerator is relatively small between the first degree and a second degree larger than the first degree of the opening of the throttle valve respectively corresponding to the first value and the second value of the position of the accelerator, third means which receives the output of the accelerator position sensor and determines the opening degree of the throttle valve in response to the position of the accelerator being between the second value and a maximum value such that the amount of change in the opening degree of the throttle valve for a given change in the position of the accelerator is relatively large between the second degree and full opening of the opening degree of the throttle valve respectively corresponding to the second value and the maximum value of the position of the accelerator, and a throttle valve driving means which receives outputs from the first to third means and drives the throttle valve to obtain the opening degree determined by the first, second or third means.

8. A throttle valve control system as defined in claim 7 in which said first to third means comprise memories.

9. A throttle valve control system as defined in claim 8 in which a plurality of target throttle opening degrees for a give position of the accelerator are stored in each of said memories and said throttle valve opening degree determining means selects one of the target throttle opening degrees according to the engine rpm.

10. A throttle valve control system as defined in claim 7 in which said throttle valve opening degree determining means increases the throttle opening degree for a given position of the accelerator as the engine rpm increases.

* * * * *